US006176403B1

(12) United States Patent
Svare et al.

(10) Patent No.: US 6,176,403 B1
(45) Date of Patent: Jan. 23, 2001

(54) SPORTS UTILITY BELT

(76) Inventors: Zachary D. Svare, 1135 Elm Ave.; Ryan R. Davison, 2130 290th St., both of Garner, IA (US) 50438

( * ) Notice: Under 35 U.S.C. 154(b), the term of this patent shall be extended for 0 days.

(21) Appl. No.: 09/280,365

(22) Filed: Mar. 29, 1999

Related U.S. Application Data

(60) Provisional application No. 60/079,913, filed on Mar. 30, 1998.

(51) Int. Cl.[7] ..... A45F 5/00

(52) U.S. Cl. ..... 224/251; 224/250; 224/246; 224/271; 224/682; 224/919; 206/315.1; D3/221; D3/229; D3/254; D3/329

(58) Field of Search ..... 224/250, 251, 224/246, 247, 271, 272, 665, 676, 678, 919, 922, 914, 651, 682; D3/221, 229, 254, 329; 206/315.1

(56) References Cited

U.S. PATENT DOCUMENTS

| | | | | |
|---|---|---|---|---|
| 710,236 | * | 9/1902 | Audley | 224/914 X |
| 1,814,887 | * | 7/1931 | Bender | 224/919 X |
| 1,911,256 | * | 5/1933 | Andrew | 224/919 X |
| 3,369,723 | * | 2/1968 | Saari et al. | 224/250 X |
| 4,662,552 | * | 5/1987 | Uyehara | 224/251 |
| 4,693,402 | * | 9/1987 | Comeau | 224/919 X |
| 4,709,693 | * | 12/1987 | Key | 224/250 X |
| 4,762,257 | * | 8/1988 | Spillers et al. | 224/250 X |
| 4,796,790 | * | 1/1989 | Hamilton | 224/250 X |
| 4,863,083 | * | 9/1989 | Chen | 224/250 X |
| 4,955,518 | * | 9/1990 | Parson et al. | 224/251 X |
| 5,064,107 | * | 11/1991 | Ascarrunz | 224/247 |
| 5,174,481 | * | 12/1992 | LeDune | 224/250 X |
| 5,571,228 | * | 11/1996 | McMurtrie | 224/247 |
| 5,586,706 | * | 12/1996 | Ritzenhein | 224/251 X |
| 5,647,522 | * | 7/1997 | Routh | 224/250 X |
| 5,718,363 | * | 2/1998 | Graves | 224/250 |
| 5,813,581 | * | 9/1998 | Hellweg | 224/251 |
| 5,829,656 | * | 11/1998 | Reitz et al. | 224/250 X |
| 5,964,386 | * | 10/1999 | Cote | 224/250 |

* cited by examiner

*Primary Examiner*—Gregory M. Vidovich
(74) *Attorney, Agent, or Firm*—Zarley, McKee, Thomte, Voorhees & Sease

(57) ABSTRACT

A sports utility belt includes a belt adapted to be worn around the waste of a player, and a bat holder attached to the belt and adapted to hold either a baseball or softball bat. The bat holder has an inner surface contoured to fit a portion of the bat and hold the bat in a substantially horizontal position behind the player. The bat holder is preferably made from two sections separated by a living hinge that allows the bat holder to open and close. The sports utility belt may also include a pouch attached to the belt to hold a baseball or softball and a strap adapted to secure a baseball or softball glove to the belt.

12 Claims, 2 Drawing Sheets

SPORTS UTILITY BELT

CROSS-REFERENCE TO RELATED APPLICATIONS

This application claims the benefit of U.S. Provisional Application Ser. No. 60/079,913 filed Mar. 30, 1998.

BACKGROUND OF THE INVENTION

1. Field of the Invention

The present invention relates to sports accessories. More particularly, though not exclusively, the present invention relates to a sports utility belt for use in the transport of a baseball bat and like articles.

2. Problems in the Art

Each year hundreds of thousands of people participate in recreational baseball and softball leagues. The young adults and children that participate often rely on bicycles, mopeds, and skateboards as means of transportation to and from games and practices. It is a common site, for example, to see Little League baseball players ride their bikes to the baseball field, carrying a baseball bat and glove. Typically, a player will hold the bat in one hand and steer the bike with the other. Because both hands of the player are not free, this makes the player more susceptible to a traffic accident. In addition, the bat or glove may drop from the player's hand and actually cause the accident. Thus, there is a need in the art for a device that provides for a safer means of transporting baseball and softball equipment.

Another problem in the art is that baseball and softball equipment is not inexpensive and can easily become damaged during transport. Unless securely attached to either the player or the bicycle, for example, the equipment may impact against the bicycle or the road, scratching and marring the equipment. Thus, there is also a need in the art for a device that protects baseball and softball equipment from damage during transport.

Yet another problem in the art is the need for a device to use in the transport of baseball and softball equipment that is both comfortable and esthetically pleasing to the user. An apparatus or device to be worn by a player that is either uncomfortable or unsightly will simply not get used.

FEATURES OF THE INVENTION

A general feature of the present invention is the provision of a method and means for transporting baseball and softball equipment which overcomes the problems found in the prior art.

A further feature of the present invention is the provision of a sports utility belt that holds the baseball and softball equipment, freeing the hands of the wearer during transport using a bicycle or similar means.

A further feature of the present invention is the provision of a sports utility belt that adequately secures the baseball and softball equipment to ensure that the equipment does not become damaged during transport.

A still further feature of the present invention is the provision of a sports utility belt that is comfortable to wear.

A further feature of the present invention is the provision of a sports utility belt that is esthetically pleasing to the wearer.

A further feature of the present invention is the provision of a sports utility belt that is efficient in operation and durable in use.

These as well as other features and advantages of the present invention will become apparent from the following specification and claims.

SUMMARY OF THE INVENTION

The sports utility belt of the present invention includes a belt adapted to be worn around the waste of the player, and a bat holder attached to the belt and adapted to hold either a baseball or softball bat. In its preferred form, the bat holder of the sports utility belt has an inner surface contoured to fit a portion of the bat and hold the bat in a substantially horizontal position behind the player. The bat holder is preferably made from two sections separated by a living hinge that allows the bat holder to open and close. The sports utility belt may also include a pouch attached to the belt to hold a baseball or softball and a strap adapted to secure a baseball or softball glove to the belt.

The present invention also includes a method of transporting a baseball or softball bat having the advantage of freeing the hands of the player to operate a vehicle, such as a bicycle, moped or skateboard. The method generally includes the steps of providing a sports utility belt as described above, inserting the bat into the bat holder, fastening the belt around the waste of the player, and driving the vehicle to the desired destination.

DETAILED DESCRIPTION OF THE PREFERRED EMBODIMENT

The present invention will be described as it applies to its preferred embodiment. It is not intended that the present invention be limited to the described embodiment. It is intended that the invention cover all modifications and alternatives which may be included within the spirit and scope of the invention.

Figure 1:
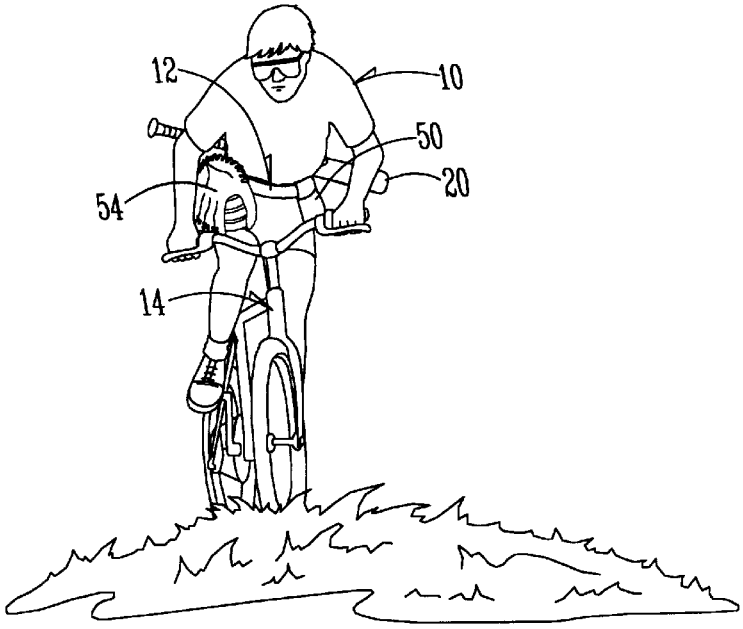
FIG. 1 is a pictorial view of a baseball or softball player wearing a sports utility belt of the present invention.

Now referring to the drawings, FIG. 1 shows a baseball or softball player 10 wearing a sports utility belt 12 of the present invention while riding a bicycle 14. The sports utility belt 12, shown in more detail in FIG. 2, includes a belt 16 with fasteners (not shown) for securing the belt 16 around the waste of the player or wearer 10. The belt 16 may be made from a variety of different flexible materials. Nylon belting has been found durable and suitable for use.

Figure 2:
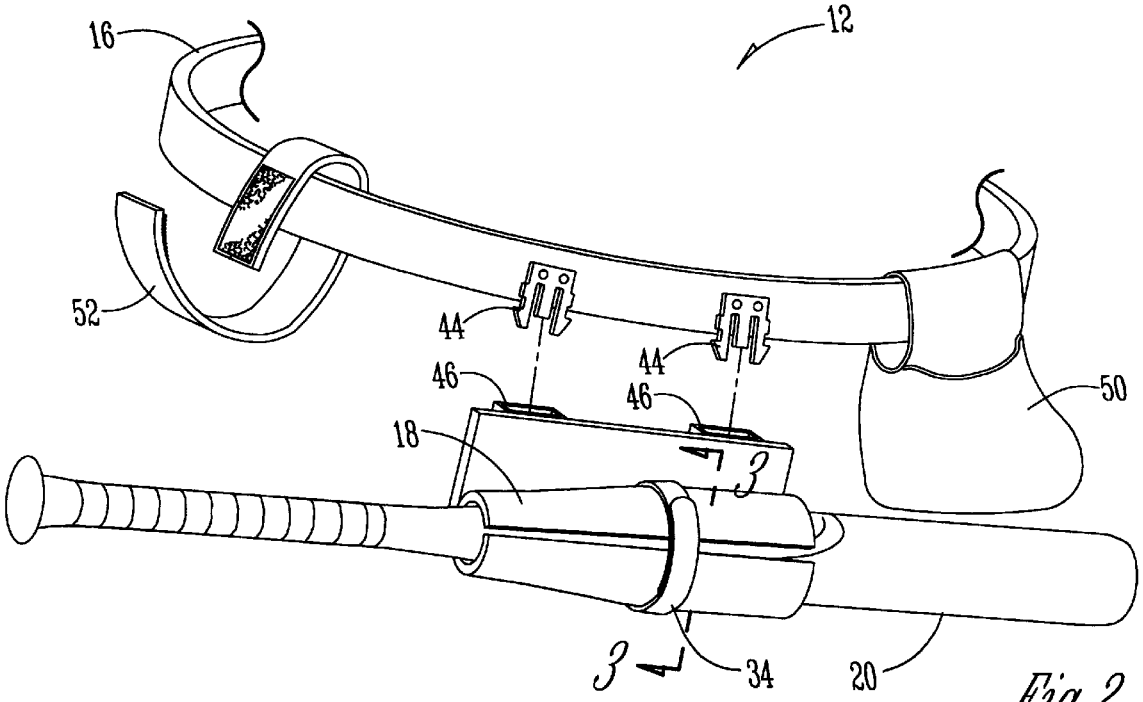
FIG. 2 is a partial exploded perspective view of the sports utility belt of the present invention.
Figure 3:
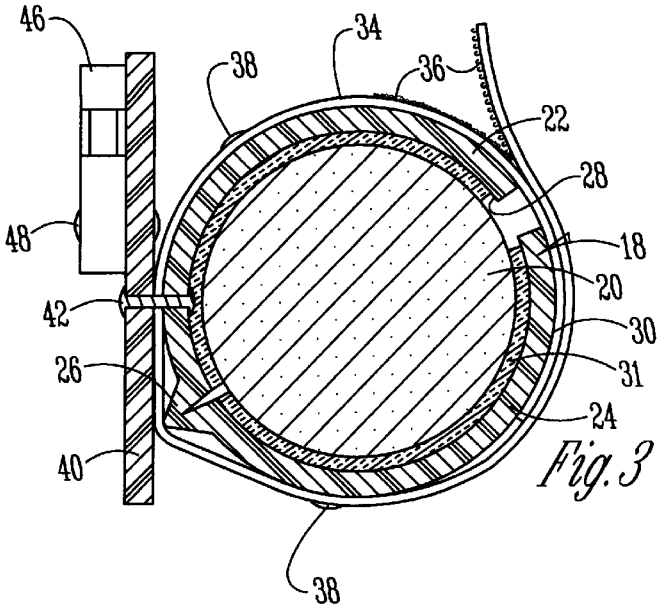
FIG. 3 is a sectional view taken along line 3—3 of FIG. 2, showing the bat holder in a closed position.
Figure 4:
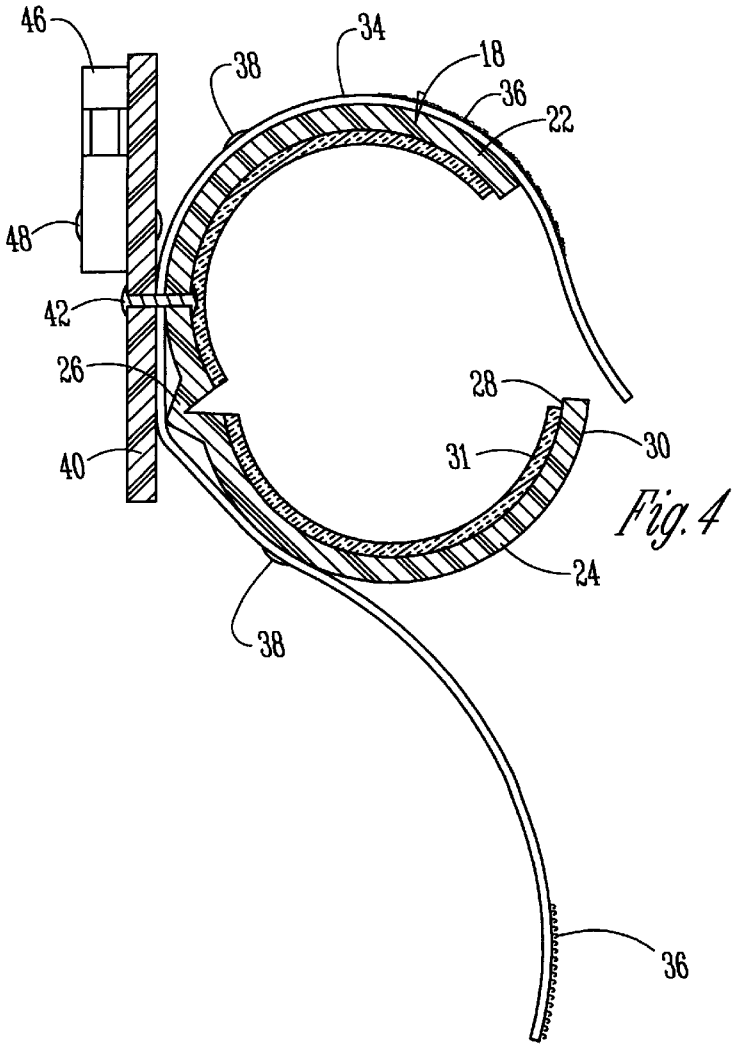
FIG. 4 is a sectional view similar to FIG. 3, showing the bat holder in an open position.

The sports utility belt 12 also includes a bat holder 18 sized to accommodate either a baseball or softball bat 20. As best shown in FIGS. 2 through 4, the bat holder 18 includes a first section 22 and a second section 24 forming a circular cylinder around the bat 20. The first and second sections are joined by a living hinge 26 that allows the bat holder 18 to hinge between an open position, shown in FIG. 4, and a closed position, shown in FIG. 3. The bat holder 18 has an inner surface 28 and an outer surface 30. The inner surface 28 of the bat holder 18 is contoured to fit a portion of the bat 20 and secure the bat in a compression fit when in the closed position. The bat holder 18 should have a rigid construction and is preferably made of a hard plastic material or lightweight aluminum.

A flexible gripping member 31 is disposed between the inner surface 28 of the bat holder 18 and the bat 20. The gripping member 31 helps to maintain a tight fit around the bat 20. Although the gripping member 31 may be made from a variety of materials, high density foam has been found most effective. The gripping member 31 may be glued and/or recessed into the inner surface 28 of the bat holder 18.

A strap 34 having loop and hook fasteners 36 is provided to wrap around the bat holder 18 to maintain the bat 20 in a compression fit while in the closed position. The strap 34 is held in place on the outer surface 30 of the bat holder 18 by screws 38. It can be appreciated that various other fastening means could be used to hold the first and second sections 22 and 24 together in the closed position around the bat 20.

A mounting plate 40 attaches the bat holder 18 to the belt 16. As best shown in FIG. 2, the bat holder 18 when attached to the belt 16 maintains the bat 20 in a substantially horizontal position. This helps to ensure that bat 20 will not interfere with the bicycle 14 or other vehicle during transport.

The mounting plate is formed of a plastic or lightweight aluminum plate and is fixed to the bat holder by means of one or more rivets 42. The mounting plate 40 is detachably mounted to the belt 16 using plastic clasps. A pair of male clasps 44 are fixed to the belt 16 and are received in two female clasp receivers 46 attached to the mounting plate 40 with screws 48. It can be appreciated that such a construction allows the bat holder 18 to be interchanged with other holders for attachment to the belt 16. For example, another holder could be provided for a tennis racquet, and another for a lacrosse club.

The male clasps 44 are positioned along the belt 16 such that bat 20 is held behind the wearer 12. In this position, the bat 20 is less likely to interfere in the operation of the bicycle 14 or other vehicle.

The sports utility belt 12 also includes a pouch 50 attached the belt 16 and sized to hold either a baseball or softball. A strap 52 is provided on the belt 16. The strap 52 may be looped through the handle of a baseball or softball glove 54 to secure the glove to the belt 16.

In light of the prior description of the sports utility belt 12, its operation and method of use can be easily understood. The bat 20 is inserted into the bat holder 18 while in the open position. The first and second sections 22 and 24 of the bat holder 18 are then closed around the bat 20. The strap 34 is wrapped around the bat holder 18 and secured to maintain the bat holder 18 in a compression fit around the bat 20. Next, the male clasps 44 on the belt 16 are inserted into the female receivers 46 on the mounting plate 40. At this point, the sports utility belt 12 may be fastened around the waist of the wearer 12 for transport.

From the foregoing, it can be seen that the present invention accomplishes at least all of its stated objectives and includes the aforementioned features.

What is claimed is:

1. A new sports utility belt for use in the transport of baseball or softball articles, the sports utility belt comprising:

one of a baseball bat and a softball bat; and a belt adapted to be secured around the waistline of a wearer;

a bat holder operatively attached to the belt and adapted to hold the one of a baseball bat and a softball bat in a substantially horizontal position parallel to the waistline of the wearer when the belt is worn by the wearer; and the bat holder having a first section, a second section, and a hinge between the first and second sections, the first and second sections each having an inner surface adapted to fit a portion of the bat and hold the bat in a compression fit.

2. The sports utility belt of claim 1 wherein the hinge is a living hinge.

3. The sports utility belt of claim 1 further comprising a fastener for securing the first and second sections of the bat holder around the bat.

4. The sports utility belt of claim 1 further comprising a flexible gripping member disposed between the inner surface of the bat holder and the bat.

5. The sports utility belt of claim 1 further comprising a mounting plate affixed to the bat holder and detachably mounted to the belt.

6. The sports utility belt of claim 1 further comprising a pouch attached to the belt and adapted to hold a baseball or softball.

7. The sports utility belt of claim 1 further comprising a glove strap attached to the belt and adapted to secure a baseball or softball glove to the belt.

8. The sports utility belt of claim 1 wherein the bat holder in positioned about the belt so that the bat is disposed behind the wearer.

9. A sports utility belt comprising:

a belt adapted to be secured around the waist of a wearer;

one of a baseball bat and a softball bat;

a bat holder operatively attached to the belt and adapted to hold the one of a baseball bat and a softball bat in a substantially horizontal position behind the wearer, the bat holder having an inner surface and an outer surface, the inner surface being contoured to fit a portion of the bat and hold the bat in a compression fit;

a flexible gripping member disposed between the inner surface of the bat holder and the bat;

a pouch attached to the belt and adapted to hold a baseball or softball; and a glove strap attached to the belt and adapted to secure a baseball or softball glove to the belt.

10. A method of transporting a baseball or softball bat to a destination having the advantage of freeing the hands of the user to operate a vehicle, the method comprising:

providing a sports utility belt including a belt adapted to be secured around the waistline of the wearer, a bat holder operatively attached to the belt and adapted to hold the bat in a substantially horizontal position parallel to the waistline of the wearer when the belt is worn by the wear;

inserting the bat into the bat holder;

fastening the belt around the waist of the user; and driving the vehicle to the destination.

11. The method of claim 10 wherein the bat holder is positioned about the belt so that the bat is disposed behind the user.

12. The method of claim 10 wherein the vehicle is a bicycle.

* * * * *